US011206933B2

(12) United States Patent
Serenson et al.

(10) Patent No.: US 11,206,933 B2
(45) Date of Patent: Dec. 28, 2021

(54) FEAR REDUCING BLOCKADE AND METHODS OF MAKING AND USING SAME

(71) Applicants: Ellen E. Serenson, Plantsville, CT (US); James A. Serenson, Jr., Plantsville, CT (US)

(72) Inventors: Ellen E. Serenson, Plantsville, CT (US); James A. Serenson, Jr., Plantsville, CT (US)

( * ) Notice: Subject to any disclaimer, the term of this patent is extended or adjusted under 35 U.S.C. 154(b) by 0 days.

(21) Appl. No.: 16/281,917

(22) Filed: Feb. 21, 2019

(65) Prior Publication Data

US 2019/0261784 A1 Aug. 29, 2019

Related U.S. Application Data

(60) Provisional application No. 62/634,355, filed on Feb. 23, 2018.

(51) Int. Cl.
*A47D 15/00* (2006.01)
*A47C 19/22* (2006.01)
(Continued)

(52) U.S. Cl.
CPC ..... *A47D 15/00* (2013.01); *A47C 19/22* (2013.01); *A47C 21/003* (2013.01);
(Continued)

(58) Field of Classification Search
CPC ..... A47D 15/00; A47C 19/22; A47C 21/003; A47C 31/008; A47C 19/02; A47C 19/021; A47C 19/0292; A47C 17/86
See application file for complete search history.

(56) References Cited

U.S. PATENT DOCUMENTS 1,177,390 A * 3/1916 Daniel ..... A47C 17/86 5/308
1,486,267 A * 3/1924 Salomon ..... A47B 91/06 16/42 R
(Continued)

FOREIGN PATENT DOCUMENTS

CA 2713483 A1 2/2012
CA 2853626 A1 12/2015
(Continued)

OTHER PUBLICATIONS

Sea Lemon, DIY Under Furniture Pet Toy Blocker, Oct. 2, 2015, https://www.youtube.com/watch?v=HfQNkfD21Oo.*
(Continued)

*Primary Examiner* — Nicholas F Polito
*Assistant Examiner* — Morgan J McClure
(74) *Attorney, Agent, or Firm* — UConn IP Law Clinic; Henry Purtill; Hao Zhang

(57) ABSTRACT

Disclosed herein is an apparatus to block off a space under a bed frame, the apparatus comprising a longitudinal member configured to fill a gap between a floor and a lower edge of the elongated portion of the bed frame, the first end of the longitudinal member being removably connected to the first leg of the bed frame by a first connector, and the second end of the longitudinal member being removably connected to the second leg of the bed frame by a second connector. Corresponding systems and methods also are disclosed.

10 Claims, 14 Drawing Sheets

(51) Int. Cl.
*A47C 21/00* (2006.01)
*A47C 31/00* (2006.01)
*A47C 19/02* (2006.01)

(52) U.S. Cl.
CPC ..... *A47C 31/008* (2013.01); *A47C 19/02* (2013.01); *A47C 19/021* (2013.01)

(56) References Cited

U.S. PATENT DOCUMENTS 2,093,164 A * 9/1937 De Boer ..... A47C 19/021 5/131
3,513,490 A * 5/1970 Wagner ..... A47C 19/021 5/131
3,546,725 A * 12/1970 Tambascio ..... A47C 19/02 5/200.1
3,754,289 A * 8/1973 Larkin ..... A47C 19/021 5/201
4,016,612 A * 4/1977 Barile, Sr. ..... A47C 19/021 5/200.1
4,117,782 A * 10/1978 Cahill ..... A47B 95/043 108/27
4,252,372 A * 2/1981 Harder, Jr. ..... B60N 2/6009 297/452.1
4,323,610 A * 4/1982 Leverich ..... A47B 95/043 428/100
4,811,438 A * 3/1989 Simpson ..... A47C 17/86 297/188.11
5,057,819 A * 10/1991 Valenti ..... A47D 15/001 340/539.1
5,322,257 A * 6/1994 Verderose ..... A47B 91/00 248/205.3
5,353,456 A * 10/1994 Evans ..... A47G 9/0292 5/482
5,474,377 A * 12/1995 Cone ..... A47B 23/02 248/131
5,621,931 A * 4/1997 Hamilton ..... A47G 9/0292 5/493
6,611,973 B2 * 9/2003 Connell ..... A47C 17/86 16/35 R
6,647,589 B1 * 11/2003 Youngwith ..... A47C 31/11 16/18 CG
D491,793 S * 6/2004 Corso ..... D8/374
D603,192 S * 11/2009 Priddle ..... D6/702
D622,524 S * 8/2010 Taylor ..... D6/512
7,805,781 B1 * 10/2010 Smith ..... A47C 19/02 5/280
7,845,030 B1 * 12/2010 Pollard ..... A47C 19/124 5/2.1
8,028,362 B1 * 10/2011 Barreau ..... A47C 21/00 5/663
D663,557 S * 7/2012 Marler ..... D6/716
8,465,101 B1 * 6/2013 Alvarez ..... A47B 95/002 297/182
8,966,683 B2 * 3/2015 Crucs ..... A47G 9/0207 5/482
9,060,615 B1 * 6/2015 Jaeger-Wayboer ..... F16M 13/022
9,089,222 B2 * 7/2015 Stewart ..... A47C 19/025
9,226,589 B2 * 1/2016 Tully ..... A47C 19/005
D779,679 S * 2/2017 Sartain ..... D25/48.5
9,675,181 B2 * 6/2017 Caron ..... A47C 17/86
9,681,519 B2 6/2017 Smith
D792,143 S * 7/2017 Caron ..... D6/719
D792,144 S * 7/2017 Caron ..... D6/719
10,321,775 B2 * 6/2019 Jurcenko ..... A47G 9/0292
2003/0013376 A1 1/2003 Larson
2004/0232170 A1 11/2004 Glick
2004/0237197 A1 * 12/2004 Cohen ..... A47G 9/0292 5/493
2005/0076445 A1 * 4/2005 MacEachern ..... A47C 7/002 5/663
2007/0289060 A1 * 12/2007 Berkey ..... A47D 7/002 5/99.1
2009/0174248 A1 * 7/2009 Chisholm ..... A01K 1/035 297/463.2
2010/0224692 A1 9/2010 Qumsieh
2012/0315434 A1 * 12/2012 Marler ..... A47C 31/00 428/121
2016/0100695 A1 * 4/2016 Harris ..... A47C 31/00 428/12
2016/0353898 A1 * 12/2016 Petzold ..... A47C 19/02
2017/0020297 A1 * 1/2017 Luciano ..... H05B 47/105
2017/0055715 A1 * 3/2017 Rohr ..... A47C 19/005
2017/0290445 A1 * 10/2017 Cerri, III ..... A47C 27/081
2018/0311092 A1 * 11/2018 Karl ..... A61G 7/047
2019/0000236 A1 * 1/2019 Polevoy ..... A47C 19/02

FOREIGN PATENT DOCUMENTS

CN 104337276 A 2/2015
CN 204318112 U 5/2015
KR 20140133039 A 11/2014
KR 20170129309 A 11/2017
WO 2017127381 A1 7/2017

OTHER PUBLICATIONS http://bunnyproof.com/how-to-rabbit-proof-your-house/how-to-stop-your-rabbit-going-under-and-behind-furniture Title: How to stop your rabbit going under and behind furniture. Printed on Sep. 20, 2018. 17 pages.
https://www.amazon.com/Zinus-Frame-Spring-Mattress-Beneath/dp/B06Y2K1FCZ Title: Amazon.com: Zinus 5 Inch Wood Bed Frame for Box Spring & Mattress Set, Keep Pets from Beneath Your Bed, King: Kitchen & Dining. Printed on Sep. 13, 2018. 9 pages.
https://www.containerstore.com/s/closet/under-the-bed-storage/wide-under-bed-drawer/12d?productId=10008372 Title: Wide Under Bed Drawer | The Container Store. Printed on Sep. 13, 2018. 3 pages.

* cited by examiner

FEAR REDUCING BLOCKADE AND METHODS OF MAKING AND USING SAME

TECHNICAL FIELD

The present disclosure generally relates to a device to block off a space for fear reducing, and more specifically relates to a device to block off and illuminate a dark space where a child may fear that a monster is hiding such as under a bed, in a closet or under a staircase.

BACKGROUND

It is very common and normal for children to have irrational nighttime imaginations that reduce their quality of life, such as creating fear and anxiety, stimulating nightmares, and reducing their quality of sleep. The most common irrational nighttime fears or anxieties in young children include 1) the fear that monsters are under the bed, in the closet, or in a dark shadow, and 2) the fear of the dark. While the peak of these fears occur between the ages of 4 and 6 (NSS/Harvard 2010), children ages 7 to 13 still have fear of the dark on their top 10 list (Muris 1997). In a study of Dutch children, greater than 73% of school aged children aged 4 through 12 suffer from nighttime fears (Muris et al 2001). Another study of Australian children found that 64% of kids between 8 and 16 admitted to nighttime anxieties or fears (Gordon et al 2007).

Irrational nighttime fears or anxieties are part of the normal development of a child. It is believed that younger children have irrational fears because their brain is developing its ability to be creative and imaginative while their frontal lobes, which allow them to reason and problem solve, are not fully developed until the age of 5-6 years old (Eliot 2000). Based on this, they are not able to resolve these irrational fears or anxieties independently yet. This should be taken seriously as research shows that fear and worry in childhood have be linked to difficulties in daily functioning, social functioning, academic functioning, low self-esteem, depression and drug abuse later in life (Zisenwine 2012). Given that, if parents treat their children's fears at an early age, they could help their children avoid emotional problems later in life.

SUMMARY

One embodiment described here is an apparatus to block off a space under a bed frame that includes first and second legs and an elongated portion extending between the first and second legs. The apparatus comprises a longitudinal member configured to fill a gap between a floor and a lower edge of the elongated portion of the bed frame. The longitudinal member has a first end and a second end, the first end being removably connected to the first leg of the bed frame by a first connector, and the second end being removably connected to the second leg of the bed frame by a second connector.

In some cases, the first connecter comprises at least one adjustable strap, hook-and-loop fastener (such as Velcro®), buckle, or other means of attaching at variable lengths, and the second connecter comprises at least one adjustable strap, hook-and-loop fasteners, a buckle, or other means of attaching at variable lengths.

In embodiments, the apparatus further comprises a light configured to illuminate, and the light is attachable to the longitudinal member. In some cases, the light is controlled by a controller, and the controller is wirelessly communicable through a programmed application using an electronic device. In embodiments, the light is turned on or off with a sensor, and the sensor is a motion detecting sensor, a light detecting sensor, or a combination thereof. In some cases, the length of the longitudinal member is adjustable. In embodiments, the longitudinal member is decorated with decoration including drawings, writing, artwork, textures, or molded shapes, or the longitudinal member comprises a white longitudinal member or a chalk longitudinal member with surface suitable for drawing, writing, or scratching with dry erase markers or chalk.

Another embodiment described herein is an apparatus to block off a space under a bed frame that includes first and second legs and an elongated portion extending between the first and second legs, the apparatus comprising a longitudinal member configured to fill a gap between a floor and a lower edge of the elongated portion of the bed frame, a first end cap extending from the first end of the longitudinal member and configured to cover a gap between the longitudinal member and the first leg of the bed frame and to cover at least a part of the first leg of the bed frame, and a second end cap extending from the second end of the longitudinal member and configured to cover a gap between the longitudinal member and the second leg of the bed frame and to cover at least part of the second leg of the bed frame.

In embodiments, the first end cap is in a shape of squared corner, rounded corner, curve, or other shapes, and the second end cap is in a shape of squared corner, rounded corner, curve, or other shapes. In some cases, the first or second end cap is extended from the longitudinal member using a snap-fit or other means that avows the apparatus to be shipped flatly and re-assembled easily. In embodiments, the longitudinal member is supported by a foot or at least one adjustable strap, hook-and-loop fasteners (such as Velcro®), a buckle, or other means of attaching at variable lengths.

In some cases, each end cap includes a first segment connected to the longitudinal portion and extending generally perpendicularly relative to the longitudinal portion, and a second segment connected to the first segment and extending generally parallel relative to the longitudinal portion.

Another embodiment described herein is a system comprising a bed frame and the above-described apparatus to block off a space under a bed frame.

Yet another embodiment is a method of reducing nighttime fear in a child comprising removably mounting the above-described apparatus beneath the child's bed frame.

A further embodiment described herein is a fear reducing device comprises a structure or form to physically block the space to re-assure a child that a monster cannot enter, exit, or reach out from a dark place, especially under a bed, in a closet, under a stair case, or other dark area.

DETAILED DESCRIPTION

Figure 1:
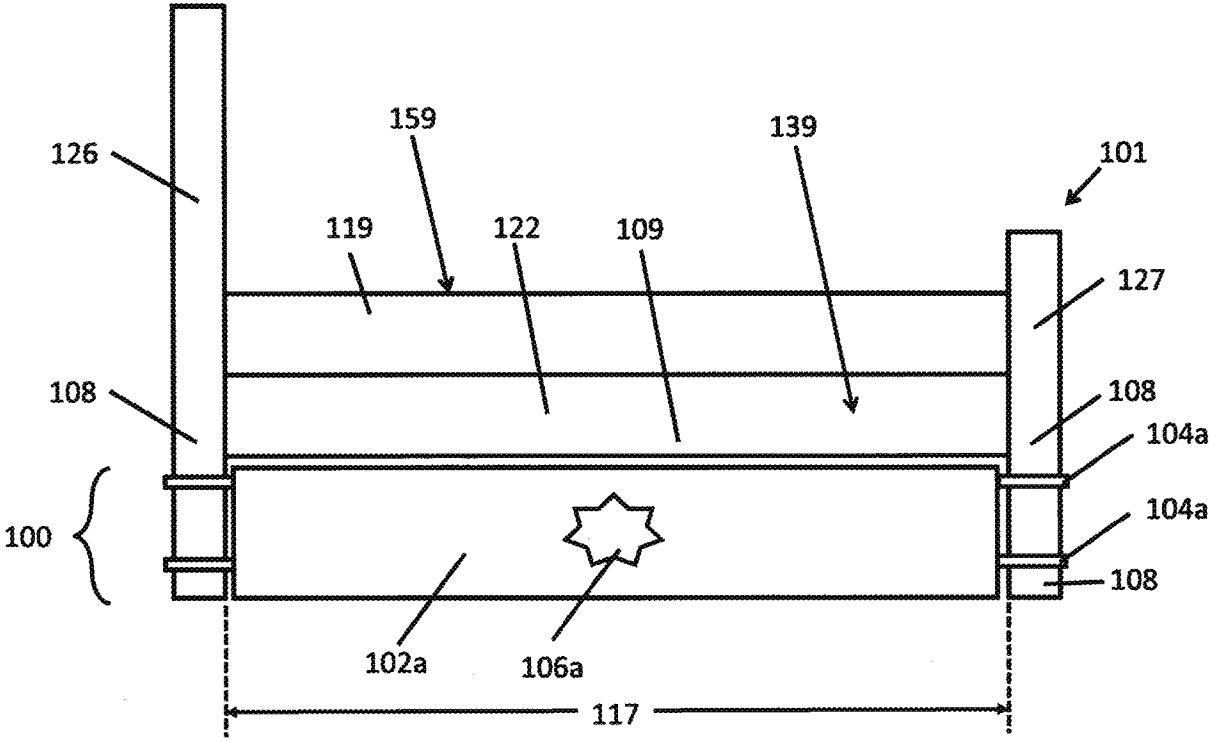
FIG. 1 illustrates a device 100 according to a first embodiment.

The embodiments described herein comprise blockades that are placed under a bed, in a closet, or in another dark place to mitigate the irrational fear that a monster is hiding in those places. They physically block the space so that it is perceived that a monster cannot enter, exit, or reach out from that space. They may also have a light to illuminate the area, eliminating dark shadows that could hide a monster. The light can be turned on at set times with a controller, with a light sensor and/or with a motion sensor, so that the user is assured that the light will be on when needed. The devices can be configured to be removable so that it is still easy to access the space behind it and can be easily removed when a child outgrows the need for the device. They may also be decorated with designs, pictures, textures, or molded shapes to be aesthetically additive to the room. They also prevent children from making a mess under the bed. The devices may be easily removed so that a user can utilize the space behind the device for storage, and the devices do not detract from the room's aesthetics. The devices may have integrated drawers and/or doors to better leverage the storage space.

In some cases, end caps are added to cover gaps between bed legs and the device to eliminate visible gaps and make the device free standing. In some cases, the light is turned on with a motion sensor to re-assure the user that the light will be on when needed. In some cases, the light is turned on and/or off with a light detecting sensor to re-assure the user that the light will be on when needed and simplify the device programming. The controller can be programmed to be wireless for use in a computerized application using an electronic device. The device can include doors or drawers added for enhanced storage. The device optionally includes a hand held remote control. The device enhances beds, closets, and other dark areas offering programmable lighting, enhanced storage, and improves aesthetics that a person with nighttime fears would value.

One embodiment is an apparatus comprising a blockade configured to occupy space between a floor and at least one of a mattress, a bed frame, and a door, the blockade including a generally vertically extending first wall and a support configured to hold the blockade in a stationary position. The blockade and the support are formed as a unitary component. The support is positioned on the floor. The blockade is configured to occupy space between a floor and a mattress on a bed frame, and the blockade includes a first portion configured for use along a side of a bed and a second portion configured for use along an end of a bed. The apparatus comprises a light controlled by a controller. The light is turned on and/or off with a light detecting sensor to re-assure the user that the light will be on when needed and simplify the device programming. The controller is programmed to be wireless for use in a computerized application on an electronic device. The apparatus further comprises a door or drawer included for enhanced storage. The controller is operated using a hand held remote control.

The present disclosure describes aspects of the disclosed embodiments with reference to the exemplary embodiments illustrated in the drawings; however, aspects of the present invention are not limited to the exemplary embodiments illustrated in the drawings. It will be apparent to those of ordinary skill in the art that aspects of the present invention include many more embodiments. Accordingly, aspects of the present invention are not to be restricted in light of the exemplary embodiments illustrated in the drawings. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

FIGS. 1 and 3-6 are side views of a bed to illustrate a device according embodiments used for one side of the bed (i.e., the right side of a person lying on their back on the bed). However, the device can be used in the other side of the bed (i.e., the left side of a person lying on their back the bed), the head end of the bed, or the foot end of the bed.

FIG. 1 illustrates a device 100 according to a first embodiment. FIG. 1 shows the side 139 of a bed 159. The device 100 is in its simplest form, which includes a longitudinal member 102*a* that fills the space under an elongated portion 122 of a bed frame 109 that supports one or more mattresses 119. The bed frame 109 and one or more mattresses 119 form the bed 159. The longitudinal member 102*a* is attached to the bed legs (which may be formed by the lower portion of the posts 126, 127) 108 of the bed frame 109. In embodiments, the device 100 is removably attached to the bed legs 108 proximate the lower end thereof. The longitudinal member 102*a* may be decorated with a decoration 106*a* including drawings, writing, artwork, textures and/or molded shapes that are additive to the aesthetics of the room. The decoration 106*a* could be directly attached to the longitudinal member 102*a*, a film that is laminated to it, stickers that are applied to it or any other means of aesthetically enhancing the longitudinal member 102*a*. The longitudinal member 102*a* may have a white board or chalk board surface to be drawn or wrote on with dry erase markers or chalk, respectively. Thus, the longitudinal member 102*a* is not necessarily made from a single material, and it may include multiple layers. The longitudinal member 102*a* is typically made of hard material such as plastic, wood, fiberglass, press board, cardboard, and glass. The longitudinal member 102*a* may be flat and/or thin, or with a certain thickness. The device 100 in combination with a bed frame 109 (including the bed legs 108) forms a system 101. The system 101 may further include the mattress 119, but it is not necessary.

In embodiments, the adjustable straps 104*a* conform to bed legs 108 in different shapes and sizes. The adjustable straps 104*a* are typically made of flexible materials such as leather, fabric, thermoplastic, thermoset or other elastomer. The straps may be made of an elastic or an inelastic material. A part of the adjustable straps 104*a*, such as an end portion, is attached to the longitudinal member 102*a* and the adjustable straps 104*a* have an adjustable means of attachment, such as a Velcro connection, a buckle, or some other means of attaching at variable lengths, to the bed legs 108. In embodiments, the straps are configured to be tied in knots, bows, or the like. In the embodiment shown in FIG. 1, each end of the longitudinal member has an upper strap 104*a* and a lower strap 104*a*. The longitudinal member 102*a* has a length shown at 117.

In some cases, the longitudinal member comprises a board. The board may be made of wood, plastic, durable cardboard, composite, or another rigid material. In embodiments, the longitudinal member is solid or hollow.

Figure 2:
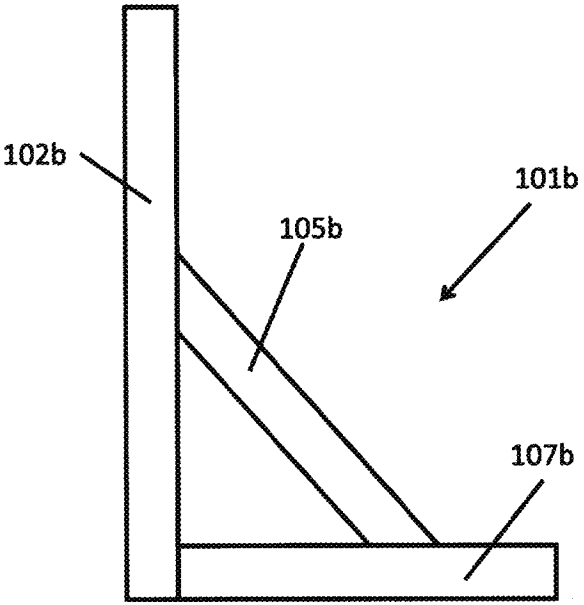
FIG. 2 is a side view of an alternative design of the device 100 according to the first embodiment.

Alternatively, as shown in FIG. 2, a device designated as 101*b* includes horizontally extending feet 107*b*, which are attached to opposite ends of the longitudinal member 102*b* for support. One or more additional feet 107*b* optionally can be included along the length of the longitudinal member 102*b*. The feet 107*b* extend generally at a perpendicular angle relative to the longitudinal member on the back side of the longitudinal member 102*b*. When using a foot 107*b*, a support beam 105*b* connecting the foot 107*b* to the longitudinal member 102*b*, such as a diagonal beam, can be added for additional support if desired. The feet 107*b* may be used in addition to, or in place of, the attachment of the adjustable straps 104*b* to the longitudinal member 102*b*. The devices 100, 101 requires either the use of several adjustable straps 104*a* to hold it in position, and/or the inclusion of feet 107*b* on the longitudinal member 102*b*.

In some cases, the device 100 would be the lowest cost design, but in certain cases it might not be able to fully fill the gaps between the longitudinal member 102*a* and the bed legs 108. These gaps could allow a child to see into the dark spaces around the longitudinal member. Other more elaborate designs address this issue. In devices 110, 130, 150, 160, 165, 180, described below, the adjustable straps 104 or the feet 107*b* may be included, but are not necessary.

To assure a child that a monster cannot enter, exit, or reach out from the space behind the longitudinal member 102*a*, in many cases it is desirable to have the gap between the bed legs 108 and the longitudinal member 102*a* be as small as possible. However, a gap is required for easy installation and removal of the device 100 as well as to allow for some size variation in different bed designs. To accommodate this, the typical gap is approximately 1" in average, ranging from ¼" to 2". The height from the exterior bottom of the bed frame 109 to the floor is usually in the range of 8" to 12", but can vary widely from 4" or smaller in low profile bed frames to up to 18" in beds designed for maximum under bed storage. Thus, the height of the longitudinal member 102*a* is usually from 7" to 11", but may range from 2" to 17¾". The thickness of the longitudinal member typically is within the range of about ¼" to about 1" but could vary widely based on the specific materials and design used.

Table 1 shows some common mattress dimensions by size. The distance 117 between the bed legs 108 in the length direction of the mattress is normally similar to the length of the mattress, and the distance (not shown in FIG. 1) between the bed legs 108 in the width direction of the mattress is normally similar to the width of the mattress. To achieve a typical 1" gap on each side of the longitudinal member 102*a-h*, 102*i*, while still allowing for some variance in the bed dimensions, the typical length of the longitudinal member 102*a-h*, 102*i* would be 2" shorter than the distance between the bed legs 108 in the respective direction of the mattress. Thus, the typical length of the longitudinal member 102*a-g*, 102*i*, that is placed at the side of a bed would be approximately 49.5" in a crib, 72" in twin and full beds, 78" in twin XL, queen, and king beds, and 82" in California king beds; while the typical length of the longitudinal member 103*g*, 103*h*, 103*j* that is placed at the head or end of a bed would be approximately 26" in a crib, 37" in twin and twin XL beds, 52" in full beds, 58" in queen beds, 74" in king beds, and 70" in California king beds. All of these lengths could vary +/−6" depending on the particular bed design.

TABLE 1

Typical mattress dimensions

| Mattress Size | Width, inches | Length, inches |
|---|---|---|
| Crib | 28 | 51⅝ |
| Twin | 39 | 74 |
| Twin XL | 39 | 80 |
| Full | 54 | 74 |
| Queen | 60 | 80 |
| King | 76 | 80 |
| California King | 72 | 84 |

Figure 3:
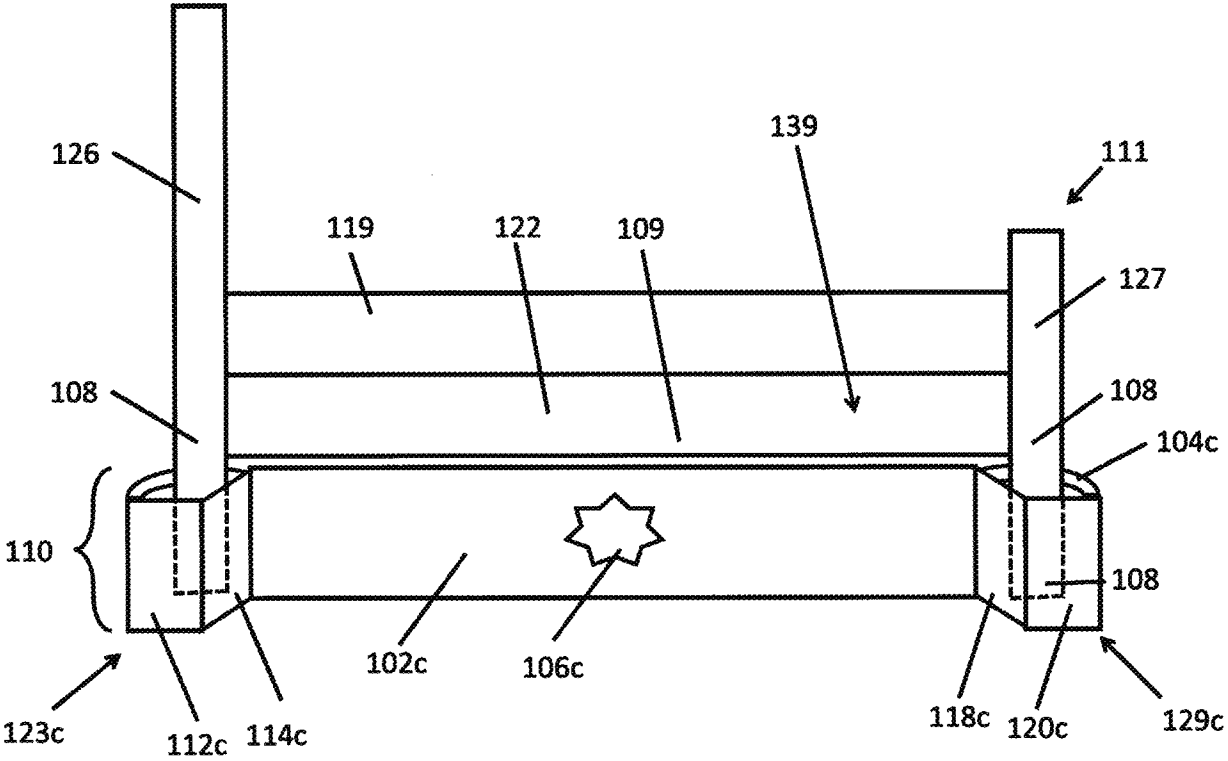
FIG. 3 illustrates a device 110 according to a second embodiment.

FIG. 3 illustrates a device 110 according to a second embodiment. FIG. 3 shows the side 139 of a bed. This embodiment shows a system 111 that includes the device 110 and a bed frame 109 (including the longitudinally extending side supports, transversely extending mattress supports, and the bed legs 108). The device 110 makes an improvement on the device 100 by adding an end cap 123, 129 at each end of the longitudinal member 102*c*. In the device 110, the front end cap 123*c* includes members 112*c* and 114*c* and the back end cap 129*c* includes members 118*c* and 120*c*. In this embodiment, the longitudinal member 102*c* is positioned beneath the bed frame 109 and optionally includes a decoration 106*c*. In embodiments, members 114*c* and 116*c* extend outwardly from beneath the bedframe in a direction that is generally perpendicular relative to the length of longitudinal member 102*c*. In embodiments, members 114*c* and 118*c* are connected to opposite ends of the longitudinal member 102*c*. In embodiments, member 112*c* is connected to, and generally perpendicular to member 114*c*, and member 120*c* is connected to, and generally perpendicular to member 118*c*. Thus, members 112*c* and 120*c* extend in a direction that is generally parallel to the length of longitudinal member 102*c*. The device 110 in combination with a bed frame 109 (including the bed legs 108) forms the system 111. The system 111 may further include the mattress 119, but it is not necessary.

Adding the end caps 123*c*, 129*c* to create the device 110 has the benefit of eliminating any visible gaps between the longitudinal member 102*c* and the bed legs 108, which provides a higher level of assurance that no monster can enter, exit, or reach out from the space behind the device.

Adding the end caps 123*c*, 129*c* to create the device 110 also has the benefit of providing a three dimensional footprint that allows the device 110 to freely stand without being attached to adjustable straps 104*c* or being supported by a foot 107*b* (not shown in FIG. 3). Although the adjustable straps 104*c* are shown in FIG. 3, the adjustable straps 104*c* are not a necessary element of device 110.

Adding the end caps 123*c*, 129*c* to create the device 110 also has the benefit of adding depth created by offsetting the longitudinal member 102*c* underneath the bed so that it will minimize the potential for an individual to kick the device 110 when entering or exiting the bed, causing damage or unsightly marks. That is, the longitudinal member 102*c* may be placed offset toward the under-bed direction.

The end caps allow the difference between the length of the longitudinal member 102 and the distance between the bed legs 108 to be larger, typically up to 6", while still fully eliminating any visible gaps around the bed legs 108. Thus, the device 110 can accommodate a wider variation of bed dimensions and still fully eliminate any visual gaps around the bed legs 108. Thus, the typical length of longitudinal member 102*c-f* (that is placed in the side of a bed) in devices 110 (shown in FIG. 3), 130 (shown in FIG. 4), 150 (shown in FIG. 5), and 160 (shown in FIG. 6) would be approximately 45.5"-49.5" in a crib, 68"-72" in twin and full beds, 74"-78" in twin XL, queen, and king beds, and 78"-82" in California king beds. All of these lengths could vary +/−6" depending on the particular bed design.

The offset that significantly reduces the potential that the side longitudinal member 102*c* will get unintentionally kicked when an individual enters or exits the bed causing damage or unsightly marks, typically equates to the length of end cap members 114*c* and 118*c* minus 1". The offset is preferably set to be 3"-6", meaning that end cap members 114*c* and 118*c* is typically 4"-7" long but could range from 1" to 12" depending on the particular bed design. Since the longitudinal member 102*c* is set back under the side of the bed frame 109, there would be no gap between the longitudinal member 102*c* and the exterior bottom of the bed frame 109 in the horizontal direction, so that when looking down from above at the edge of the bed, a child would not see any gap and would be sure that a monster cannot enter, exit, or reach out from that space.

Figure 8:
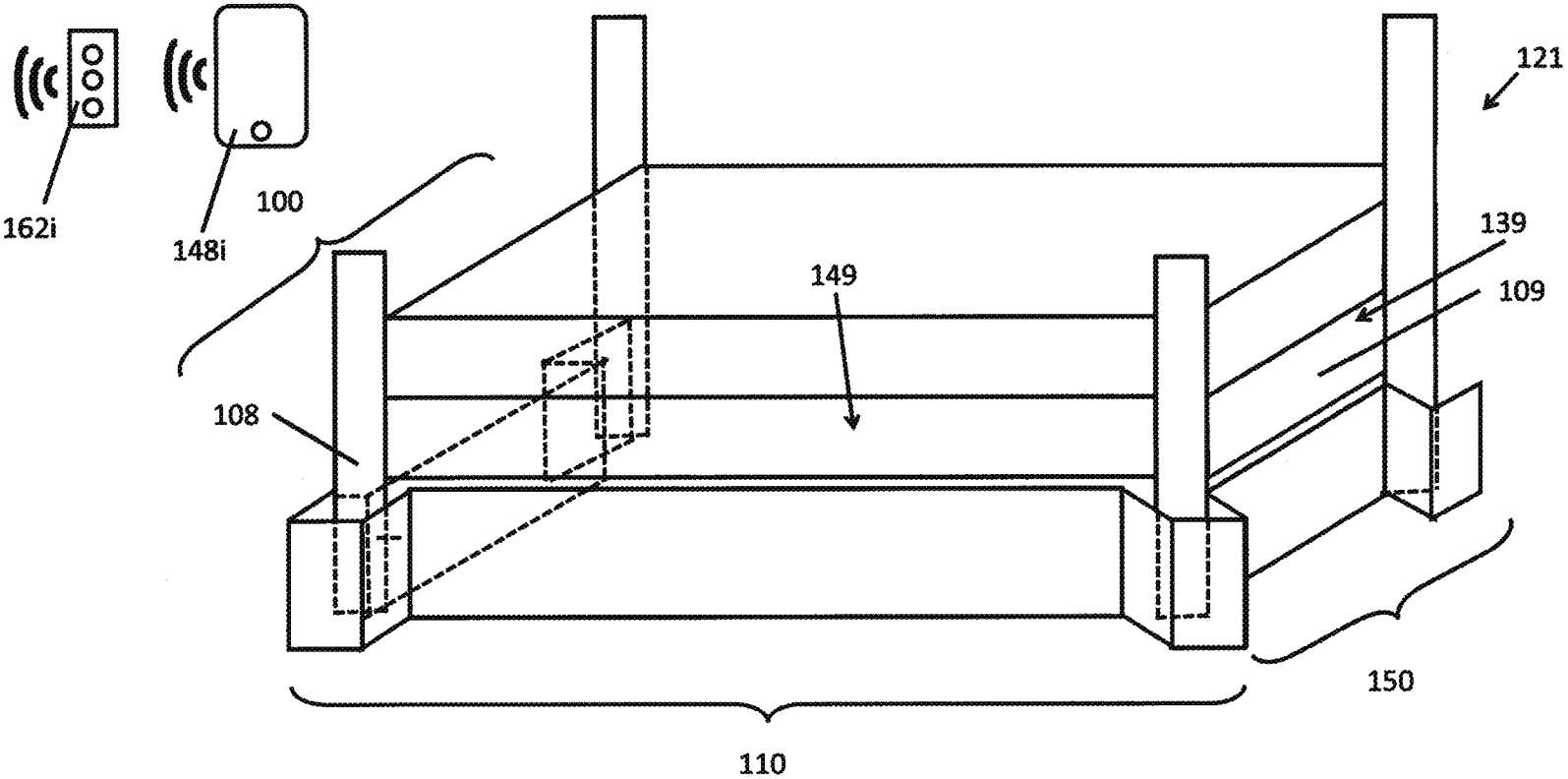
FIG. 8 illustrates multiple devices according to embodiments used for one bed.

End cap members 112*c* and 120*c* cover one exterior side of the bed legs 108. The other exterior side of the bed legs 108 (not shown in FIG. 3) can either be blocked by a wall or furniture, or be part of the end board (headboard or footboard) of the bed frame; alternatively, the other exterior side of the bed legs 108 (not shown in FIG. 3) can be covered by another device 110 as shown in FIG. 8. End cap members 112*c* and 120*c* are typically in the range of 2"-6", which is wide enough to cover the bed legs or posts, but do not hang out too far beyond the bed legs or posts to create a tripping hazard. The cap members 112*c* and 120*c* may be eliminated from some designs if it is desired to not have the end cap members visible, for example, when the device is used by adults who value the lighting, aesthetic, and storage benefits of the device, but are not afraid of monsters or dark.

Figure 4:
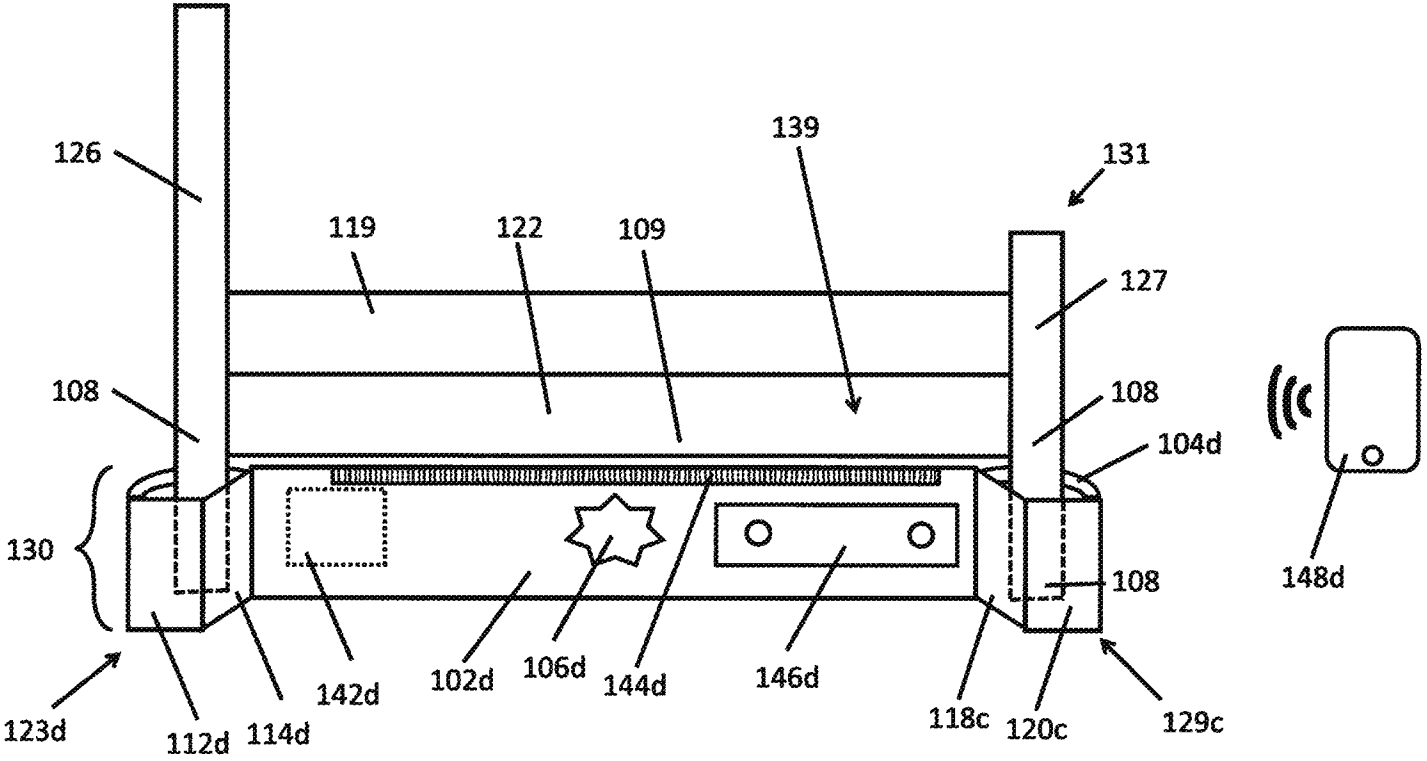
FIG. 4 illustrates a device 130 according to a third embodiment.

FIG. 4 illustrates a device 130 according to a third embodiment. FIG. 4 shows the side 139 of a bed. The device 130 includes longitudinal member 102*d*, end cap member 123*d* formed from cap members 112*d* and 114*d*, end cap member 129*d* formed from end cap members 118*d* and 120*d*, and straps 104*d*. The device 130 adds one or more lights 144*d* and a controller 142*d* to the device 110. The light 144*d* may be one or more incandescent light bulbs, light-emitting diodes (LEDs), and/or LED strips. The light 144*d* may be placed anywhere in or around the device 130. For example, a LED strip 144 shown in FIGS. 4-7 and 9 is placed at the top of the longitudinal member 102*d*-102*h*. The light 144*d* may be one color, different colors, and/or one or more multi-colored LEDs that can change color. The light 144*d* may be powered by batteries, a plug, and/or a solar panel. The device 130 in combination with a bed frame 109 (including the bed legs 108) forms a system 131. The system 131 may further include the mattress 119, but it is not necessary. This embodiment optionally includes decorations 106*d*.

The controller 142*d* is typically mounted on the back of the longitudinal member 102*d* (shown with broken lines) and turns the light on and off at set times. The controller 142*d* can control the level of illumination, the color of light, how the intensity of the light fades as it turns off, how the light changes color at set times, etc. For example, the user can have a lower intensity light of one color, red, starting at a first time point, then have it change to a brighter color, green, with higher intensity at a second time point, and finally turn off at a third time point. In some embodiments, the controller 142*d* communicates through a wired or wireless connection to a smart device 148*d* such as a computer, tablet, or smart phone for data, programming, or other exchanges between the controller 142*d* and the smart device 148*d*.

One or more simple opening 146*d* for doors or drawers optionally may be added to the longitudinal member 102*d* to allow for easier access to the storage space behind the longitudinal member. The opening 146*d* typically is rectangular in shape. For example, to add a drawer, a simple frame support structure behind the longitudinal member 102*d* can be used to support the rails for the drawer.

Figure 5:
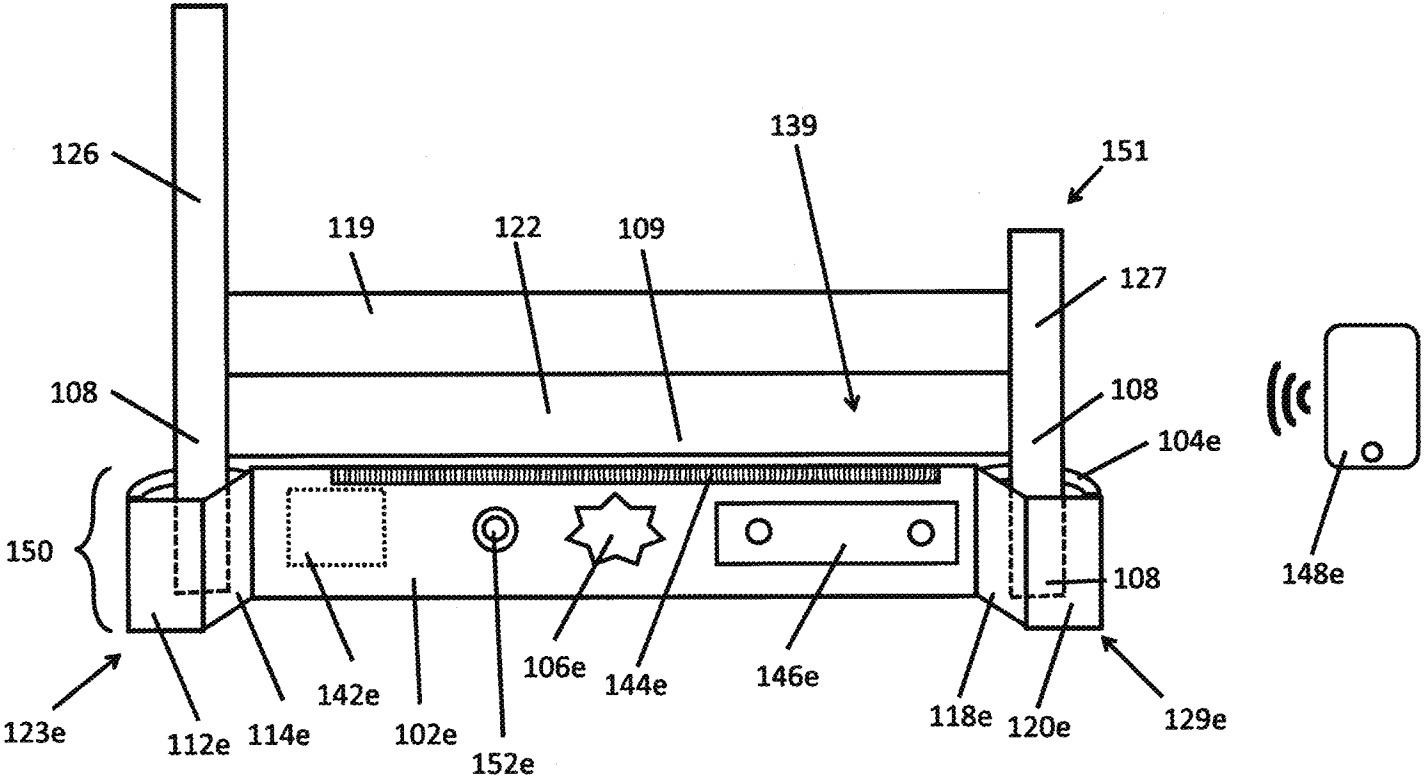
FIG. 5 illustrates a device 150 according to a fourth embodiment.

FIG. 5 illustrates a device 150 according to a fourth embodiment. FIG. 5 shows the side 139 of a bed. The device 150 includes longitudinal member 102*e*, end cap member 123*e* formed from cap members 112*e* and 114*e*, end cap member 129*e* formed from end cap members 118*e* and 120*e*, and straps 104*e*. Optionally, lights 144*e* and a drawer opening 146*e* also are included. The device 150 adds one or more sensors 152*e* to the device 130. The sensor 152*e* detects light levels, motion, or other inputs to turn the light on and off automatically. The sensor 152*e* may be a motion sensor that turns the light on when motion is detected, or a light sensor that turns the light on when the intensity of the ambient light is reduced to a certain level and turns the light off when the intensity of the ambient light increases to a certain level. The sensor 152*e* may be placed anywhere in or around the device 150. In some embodiments, the controller 142*e* communicates through a wired or wireless connection to a smart device 148*e* such as a computer, tablet, or smart phone for data, programming, or other exchanges between the controller 142*e* and the smart device 148*e*. These different types of sensors 152*e* may be used separately or combined, and may be used with the controller 142*e*. For example, a light level detecting sensor is used by the controller to turn the light on when the ambient light level reduces to a certain level and then turn the light off when it rises to a certain level. The motion detecting sensor is used by the controller to turn the light on when motion is detected, then keep the light on for a certain time period, and turn the light off automatically. An example of different types of sensors working in combination is: a) a red, moderately bright light is turned on at dusk when activated by the light level detecting sensor, b) when motion is detected, a very bright white light is turned on for a set time period, typically from 20 seconds to 5 minutes, then it turns back to the moderately bright red light, c) the controller turns the light to a bright green at a set time point, acting as an alarm, when it is time to get up, and d) the controller turns the light off at a set time point. The device 150 in combination with a bed frame 109 (including the bed legs 108) forms a system 151. The system 151 may further include the mattress 119, but it is not necessary.

Figure 6:
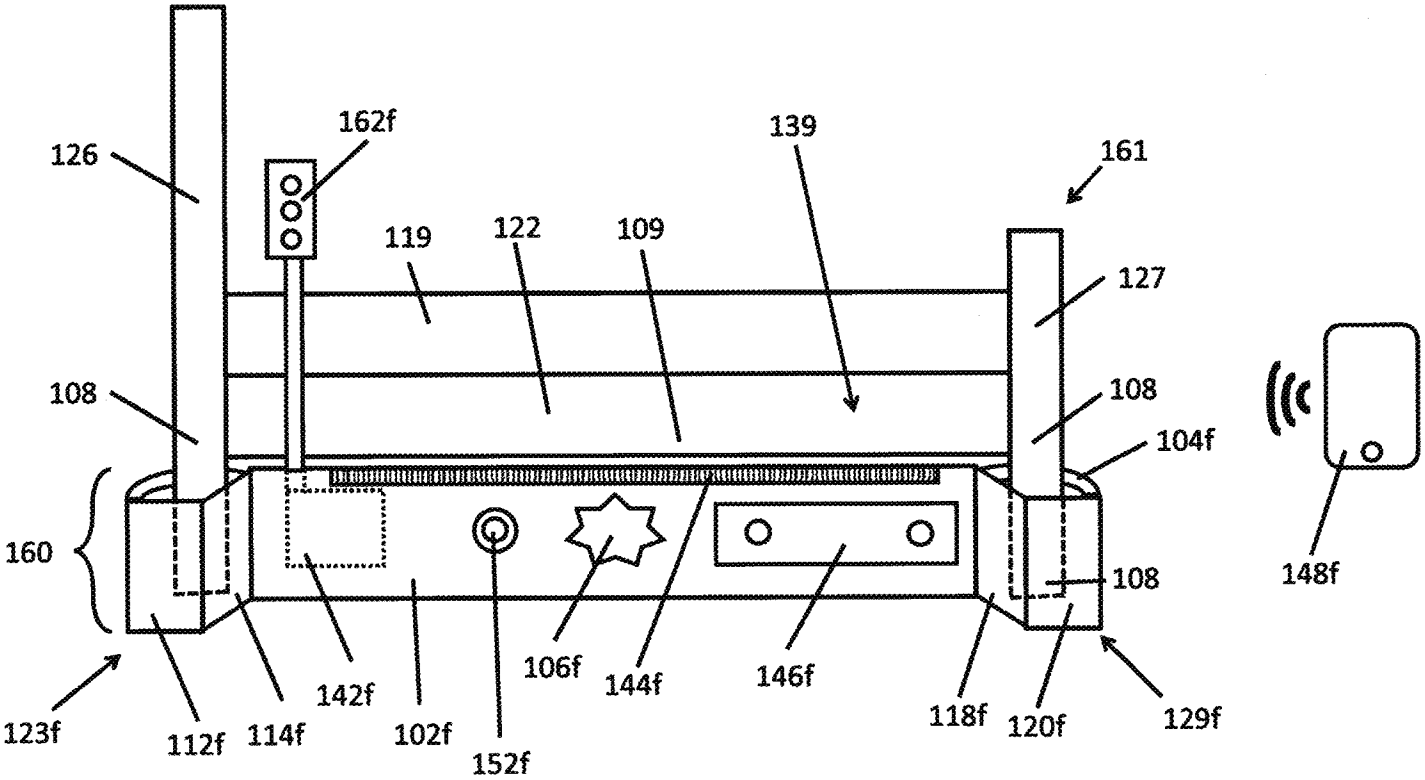
FIG. 6 illustrates a device 160 according to a fifth embodiment.

FIG. 6 illustrates a device 160 according to a fifth embodiment. FIG. 6 shows the side 139 of a bed. The device 160 includes longitudinal member 102*f*, end cap member 123*f* formed from cap members 112*f* and 114*f*, end cap member 129*f* formed from end cap members 118*f* and 120*f*, and straps 104*f*. This embodiment optionally includes a sensor 152*f* and a drawer opening 146*f*. The device 160 adds a handheld control box 162*f* to the device 150. The handheld control box 162*f* allows for manually turning the lights on or off and other controls of the light 144*f* such as changing its brightness, color, modifying the on and off times, etc. The handheld control box 162*f* may be corded as shown in FIG. 6 or a wireless remote control that operates via infrared light, blue tooth, or some other wireless means. While the control box 162*f* can alleviate the need to use a smart device 148*f* with the system, a smart device 148*f* also can be incorporated. In this case, either the control box 162*f* or the smart device 148*f*, or both can be used to control the lights. The device 160 in combination with a bed frame 109 (including the bed legs 108) forms a system 161. The system 161 may further include the mattress 119, but it is not necessary.

Figure 7:
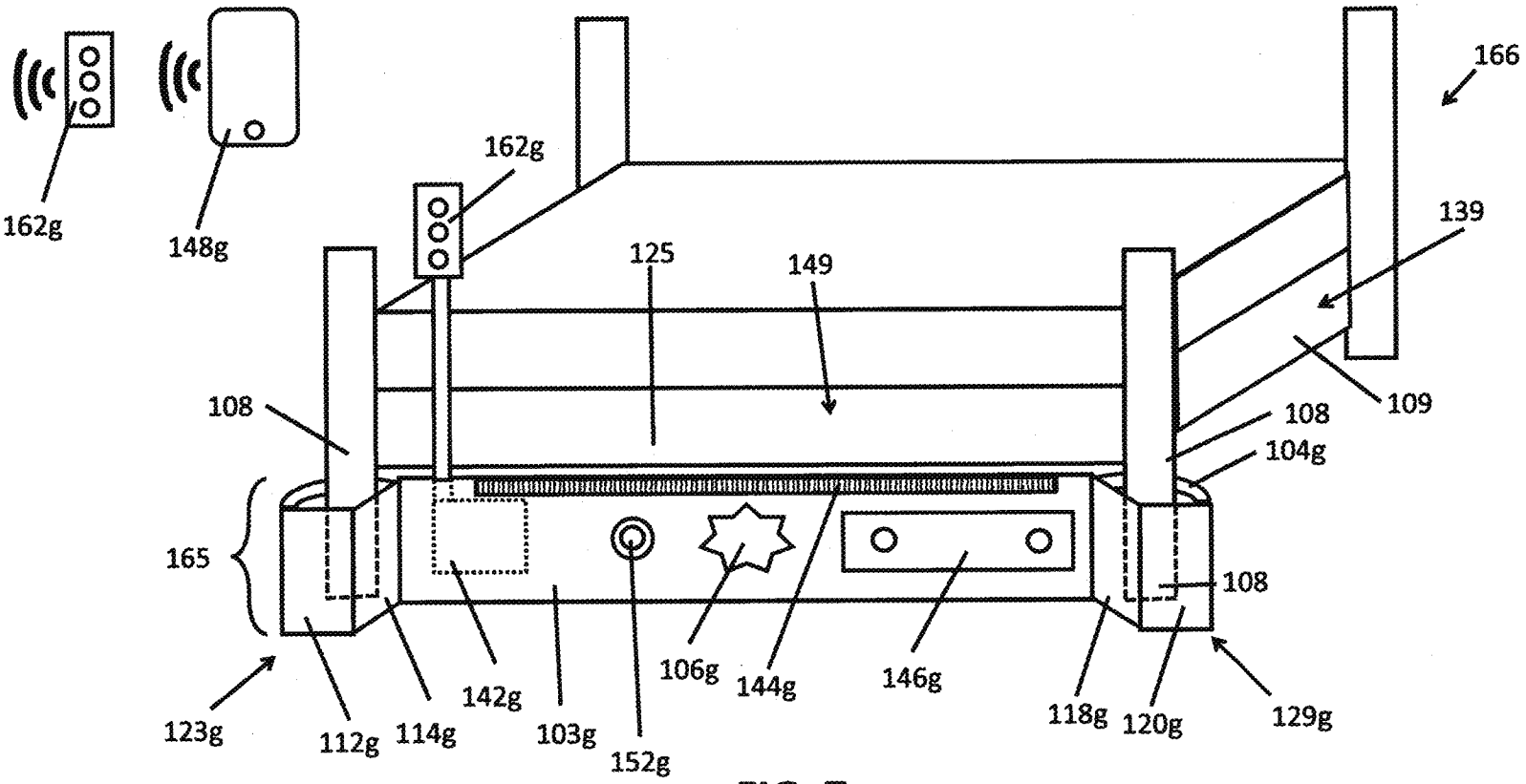
FIG. 7 illustrates a device 165 according to a sixth embodiment
Figure 9:
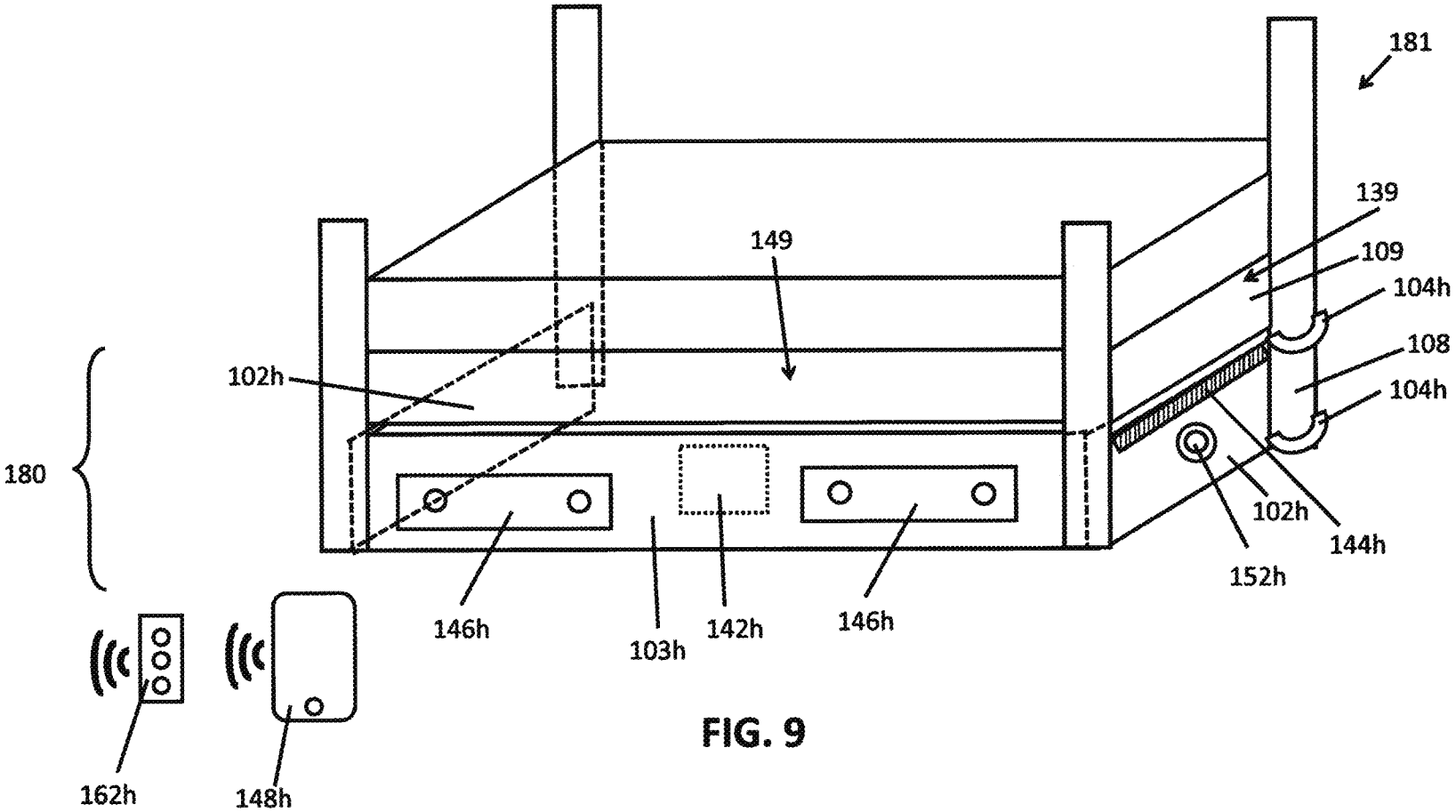
FIG. 9 illustrates a device 180 according to a seventh embodiment.

FIGS. 7-9 are perspective views of a bed to illustrate a device according to embodiments used for a front (head) end or back (foot) end of the bed, or used in combination.

FIG. 7 illustrates a device 165 according to a sixth embodiment. FIG. 7 shows the side 139 of a bed and the back (foot) end 149 of a bed. The device 165 includes longitudinal member 103*g*, end cap member 123*g* formed from cap members 112*g* and 114*g*, end cap member 129*g* formed from end cap members 118*g* and 120*g*, and straps 104*g*. The device 165 optionally includes a controller 142*g*, lights 144*g*, and an opening 146*g* for a drawer. The lights, etc. optionally can be switched on and off using a control box 162 and/or a smart device 148*g*. The device 165 is configured for the head end or foot end of a bed. The device 165 is most commonly used for the foot end of the bed, but may also be used for the head end of the bed. The device 165 in combination with a bed frame 109 (including the bed legs 108), which includes a longitudinal member 125 defining the width of the bed frame 109, forms a system 166. The system 166 may further include the mattress 119, but it is not necessary. In other embodiments, the bed frame does not include an elongated portion along the head and the foot of the bed, as the width of the bedframe 109 is defined by mattress supports positioned beneath the mattress. In this case, a box spring mattress, bunk board, or other rigid support may define the upper end of the space beneath the bed at the head end and foot end of the bed.

The key difference between the device 160 and the device 165 is that the longitudinal member 103*g* would be shorter than the longitudinal member 102*a-f*. The typical length of the longitudinal member 103 (that is placed in the head or end of a bed) would be 2"-6" shorter than the width of the mattress, or 22-26" in a crib, 33-37" in twin beds, 48-52" in full beds, 54-58" in queen beds, 70-74" in king beds, and 66-70" in California king beds. All of these lengths could vary +/−6" depending on the particular bed design. The device 165 may have any of the design variants shown for the devices 100, 110, 130, 150, and 160 in FIGS. 1-5.

FIG. 8 illustrates multiple devices used for one bed. FIG. 8 shows the side 139 of a bed and the back (foot) end 149 of a bed. The device 150 is used for one side of the bed, the device 110 is used for the head end or foot end of the bed, and the device 100 is used for the other side of the bed. Any device in different design variants shown in FIGS. 1-6, or the combination thereof, may be used on one, two, three, or four sides of one bed. The device 150, 110, 100 in combination with a bed frame 109 (including the bed legs 108) forms a system 121. The system 121 may further include the mattress, but it is not necessary.

FIG. 9 illustrates a device 180 according to a seventh embodiment. FIG. 9 shows the side 139 of a bed and the back (foot) end 149 of a bed. The device 180 includes two longitudinal members 102*h* and a longitudinal member 103*h*. Optionally, one or more of the longitudinal members can be eliminated, or an additional longitudinal member can be added at the front (head) end of the bed. The longitudinal members 102*h* and 103*h* may be directly connected. Three or four longitudinal members are typically connected, creating a two dimensional footprint that makes the device free standing as well as blocking the space a monster could enter, exit, and/or reach out from the space under the bed. The length of the longitudinal members 102*h* and 103*h* is typically shorter than the typical mattress dimensions so that they connect inside of the bed legs 108, creating a 3"-6" offset to reduce the potential of the device being unintentionally kicked. However, the length of the longitudinal members may also be slightly larger than the typical mattress dimensions so that they stay outside of the bed legs or posts if desired. The device 180 in combination with a bed frame 109 (including the bed legs 108) forms a system 1081. The system 181 may further include the mattress, but it is not necessary.

The device 180 may have all of the design variants shown in FIGS. 1-6 for each of four longitudinal members. Thus, it may offer a wide variety of locations for decoration 106*h*, controller 142*h*, light 144*h*, opening 146*h* for drawers or doors, sensor 152*h*, a remote control 162*h*, an associated smart device 148*h* or combination thereof.

Figure 10:
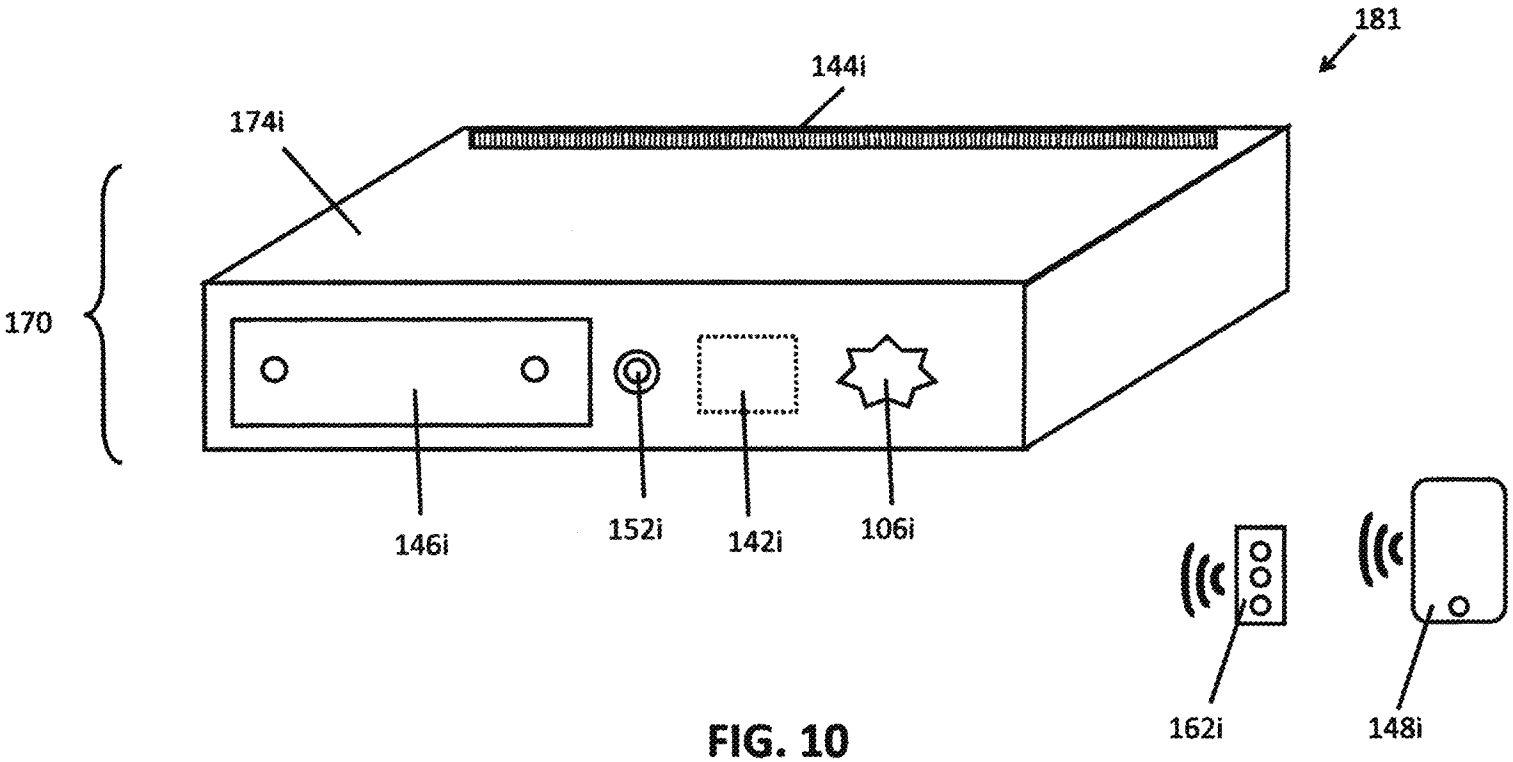
FIG. 10 illustrates a device 170 according to an eighth embodiment.

FIG. 10 illustrates a device 170 according to an eighth embodiment. The device 170 is a free standing floor design that fills the space with a rectangular box 174*i* instead of the longitudinal member as shown in FIGS. 1-9. The device 170 is usually used in a closet, but may also be used under a stairway, under a bed, or in any other area desired. The device 170 may have all the design variants and features as shown in FIGS. 1-6. Although a rectangular box is shown in FIG. 10, any three dimensional shape may be used such as a longitudinal member with a foot, a sphere, a box, a cylinder, or a three dimensional molded form, etc.

Optionally, the embodiment includes decoration 106*i*, controller 142*i*, light 144*i*, opening 146*i* for drawers or doors, sensor 152*i*, a control box 162*i*, or combination thereof. In some embodiments, the controller 142*i* communicates through a wired or wireless connection to a smart device 148*i* such as a computer, tablet, or smart phone for data, programming, or other exchanges between the controller 142*i* and the smart device 148*i*.

Figure 11:
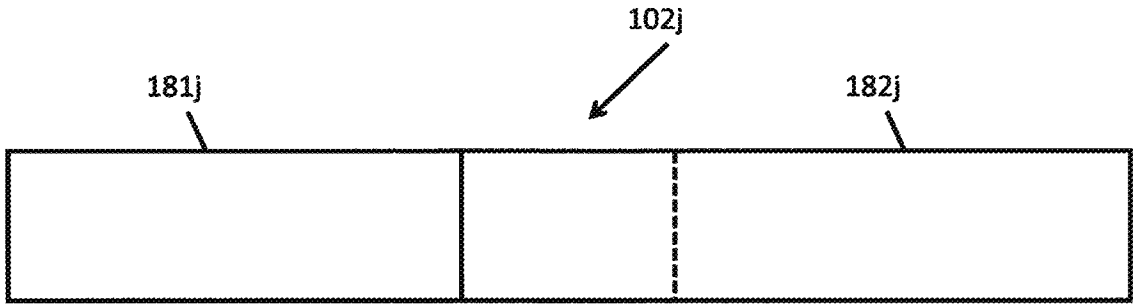
FIG. 11 illustrates a longitudinal member of a device according to a ninth embodiment.

FIG. 11 illustrates a longitudinal member 102*j* of a device according to a ninth embodiment. According to a ninth embodiment, the length of the longitudinal member is adjustable so that the same device can be used in different size beds or in different sides (includes left side, right side, head, or end) of one bed. For example, such adjustability can be achieved by sliding two longitudinal members 181*j*, 182*j* to be partially or wholly overlapped through a track arrangement. This could also be three overlapping longitudinal members to allow two shorter segments on the ends to provide the width adjustment while the larger center longitudinal member has other components on it such as lights, sensors, controllers, artwork, drawers, etc. . . . .

Figure 12:
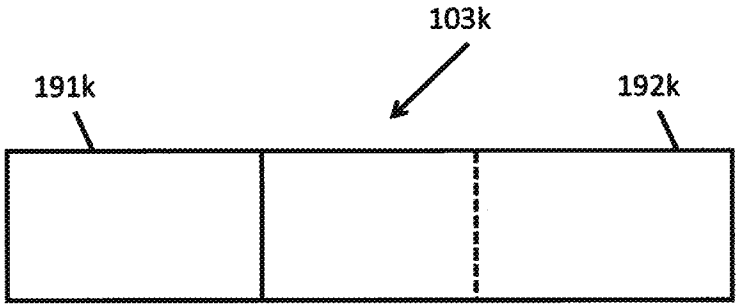
FIG. 12 illustrates a longitudinal member of a device according to a tenth embodiment.
Figure 13:
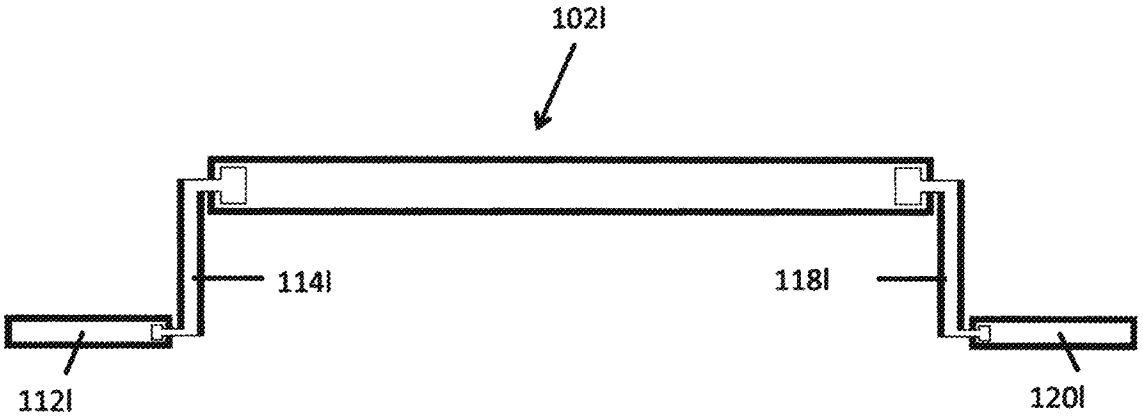
FIG. 13 illustrates a longitudinal member with end caps of a device according to an eleventh embodiment.

FIG. 12 illustrates a somewhat shorter longitudinal member 103*k* of a device according to a tenth embodiment. According to a tenth embodiment, the length of the longitudinal member is adjustable so that the same device can be used in different size beds or in different sides (including head, or end) of one bed. For example, such adjustability can be achieved by sliding two longitudinal members 191*k*, 192*k* to be partially or wholly overlapped through a track arrangement. This could also be three overlapping longitudinal members to allow two shorter segments on the ends to provide the width adjustment while the larger center longitudinal member has other components on it such as lights, sensors, controllers, artwork, drawers, etc. . . . . FIG. 13 illustrates a longitudinal member 102*l* (or 103*l*) with end caps of a device according to a eleventh embodiment. According to this embodiment, the end caps are attached to, and extend from, the longitudinal member 102*l* (or 103*l*) by using a snap-fit or other means that allows the device to be shipped flat but also easily re-assembled. A snap-fit is an assembly method used to attach parts to form the final product by pushing the parts' interlocking components together. There are a number of variations in snap fits, including cantilever, torsional and annular. Other means may include matching the connecting pieces of each other to be interlocked for assembly. For example, in FIG. 13, the connection between the end cap member 112*l* and the end cap member 114*l*, the connection between the end cap member 114*l* and the longitudinal member 102*l* (or 103*l*), the connection between the longitudinal member 102*l* (or 103*l*) and the end cap member 118*l*, and the connection between the end cap member 118*l* and the end cap member 120*l* are achieved by matching the connecting pieces of each other to be interlocked. Alternative attachment means, including screws, bolts, clips, etc. can be used.

Figure 14:
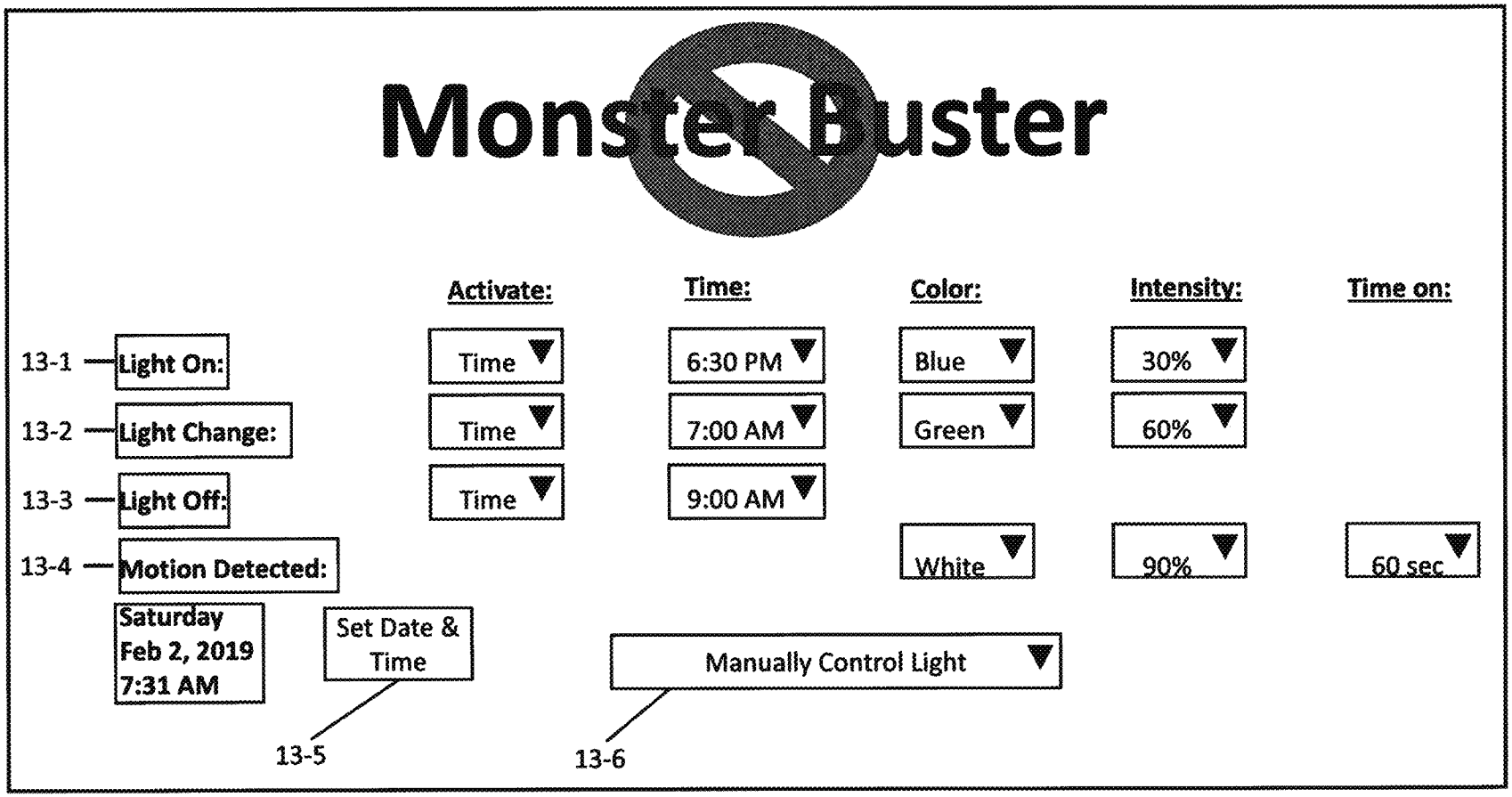
FIG. 14 is a diagram illustrating a graphical user interface in an App for the controller.

FIG. 14 is a diagram illustrating a graphical user interface in an App (application software) for the controller. This illustration gives an example of some attributes that can be controlled in the App. In FIG. 14, the rectangular boxes represent parameters that can be adjusted (e.g., through pressing) by the user.

The numerical reference 13-1 illustrates a way of controlling the light to be turned on, which includes what triggers the light to be turned on, when is the light to be turned on, what is the color of the light, and what is the intensity of the light. As an example shown in FIG. 14, the light is triggered to be turned on, with a blue color and 30% intensity, when the time is 6:30 pm. As another example, the light may be triggered to be turned on, with a color and intensity, when a light detecting sensor detects light intensity reaching to a certain level (e.g., a low light level at dusk). The user can select the triggering sensor in multi sensor designs and the respective triggering condition. The user can select the light color in multi-color light designs and the intensity of the light from 0-100%. There is also an option for the light to not be turned on if desired.

The numerical reference 13-2 illustrates a way of controlling the light characteristic to be changed, which includes what triggers the light to be changed, when is the light to be changed, what is the color of the light, and what is the intensity of the light. This setting can be used as an alarm clock or to help train children when to get up. As an example shown in FIG. 14, the light is triggered to be changed, with a green color and 60% intensity, when the time is 7:00 am. As another example, the light may be triggered to be turned on, with a color and intensity, when a light detecting sensor detects light intensity reaching to a certain level (e.g., a low light level at dusk). The user can select the triggering sensor in multi sensor designs and the respective triggering condition. The user can select the light color in multi-color light designs and the intensity of the light from 0-100%. There is also an option for the light to not be changed if desired.

The numerical reference 13-3 illustrates a way of controlling the light to be turned off, which includes what triggers the light to be turned off, and when is the light to be turned off. As an example shown in FIG. 14, the light is triggered to be turned off when the time is 9:00 am. As another example, the light may be triggered to be turned off when a light detecting sensor detects light intensity reaching to a certain level (e.g., a high light level at dawn). The user can select the triggering sensor in multi sensor designs and the respective triggering condition. There is also an option for the light to not be turned off if desired.

The numerical reference 13-4 illustrates a way of controlling the light when the motion is detected by a sensor, regardless of whether the light is currently activated or not, which includes, when motion is detected, what is the color of the light, what is the duration of light on, and what is the intensity of the light. This setting allows for a brighter illumination when needed, for example, when the user gets up to go to the bathroom during the night. As an example shown in FIG. 14, when the motion is detected, the light is turned on with a white color and 90% intensity for 60 second. The user can select the light color in multi-color light designs, the duration of light on, and the intensity of the light from 0-100%.

The numerical reference 13-5 illustrates a setting option when current status is displayed, which includes setting the current date and time. As an example shown in FIG. 14, the current status displays that the date is Saturday Feb. 2, 2019 and the time is 7:31 am.

The numerical reference 13-6 illustrates a setting option of manually controlling the light. It allows the user to manually override the current setting to control the light status, including on/off, color, intensity, using the application software. It also allows a parent to remotely control the status of the light, for example, turning the light on from another room.

Members 102, 103, 112, 114, 118 and 120, and free standing form 174 are made of materials that would hold its shape to block the space and would be perceived to be strong. For the devices 100, 110, 130, 150, 160, 165, 170, and 180, it is preferred for the members to have sufficient rigidity to allow them to be upwardly standing without the adjustable straps 104. The materials commonly used are plastic, wood, fiberglass, press board, cardboard, and glass. It may also include a combination of materials that would hold its shape, which includes materials being light and low cost, for example, a wire frame to support a fabric exterior.

Although FIGS. 1-12 show flat members with square corners, the device may be made of one or several molded pieces or one or several pieces that could be bent along the vertical axis by the user to form the two dimensional footprint of the device. The shape of the device may also be curved, have texture, 3D molded shapes, rounded corners, and/or other shapes as desired to enhance the functionality or aesthetics.

To install devices according to embodiments described herein, the user first places the device adjacent to, or underneath, a bed, in a closet, or in another desired area. For some devices, the user may need to either add batteries or plug in the cord of the device. For some devices, the user may need to use a controller and/or a remote control to configure the settings for the lights. Some devices may be attached to the bed legs or posts using the adjustable straps.

A number of alternatives, modifications, variations, or improvements therein may be subsequently made by those skilled in the art, which are also intended to be encompassed by the following claims.

What is claimed is:

1. An apparatus to block off a space under a bed frame that includes first and second legs and an elongated portion extending between the first and second legs, the apparatus comprising:

a rigid longitudinal member configured to fill a gap between a floor and a lower edge of the elongated portion of the bed frame, the longitudinal member being constructed from a continuous solid material, and having a central portion, a first end portion and a second end portion; the first end portion being removably connected to the first leg of the bed frame by a first connector, and the second end portion being removably connected to the second leg of the bed frame by a second connector, wherein the central portion of the longitudinal member is configured to be offset from the lower edge of the elongated portion of the bed frame in an under-bed direction in an amount in the range of 3 to 12 inches with respect to the first and the second end portions, and a light formed on the apparatus configured to illuminate, the light being turned on or off with a sensor comprising at least one of a motion detecting sensor and a light detecting sensor, wherein the apparatus is dimensioned to provide a gap between the apparatus and the bed frame.

2. The apparatus of claim 1, wherein the first connector comprises at least one adjustable strap, hook-and-loop fastener, or buckle, and the second connector comprises at least one adjustable strap, hook-and-loop fastener, or buckle.

3. The apparatus of claim 1, wherein the light is controlled by a controller, the controller being wirelessly communicable through a programmed application using an electronic device.

4. The apparatus of claim 1, wherein the longitudinal member has an opening configured to permit access to a drawer stored under the bed frame.

5. The apparatus of claim 1, the longitudinal member has an adjustable length.

6. The apparatus of claim 1, wherein the longitudinal member comprises a horizontal foot.

7. The apparatus of claim 1, wherein the longitudinal member is decorated with a decoration including a drawing, writing, textures, or molded shapes, or the longitudinal member comprises a white board or a chalk board with a surface suitable for drawing and writing.

8. The apparatus of claim 1, further comprising:

a first end cap extending from the first end portion of the longitudinal member and configured to cover a gap between the longitudinal member and the first leg of the bed frame and to cover at least a part of the first leg of the bed frame, and a second end cap extending from the second end portion of the longitudinal member and configured to cover a gap between the longitudinal member and the second leg of the bed frame and to cover at least a part of the second leg of the bed frame, wherein the first end cap is directly attached to the first connector and the second end cap is directly attached to the second connector.

9. A system comprising a bed frame and the apparatus of claim 1.

10. The apparatus of claim 1, wherein the rigid longitudinal member has a lower surface that is configured to be positioned on a floor.

* * * * *